US007019233B2

(12) United States Patent
Spies

(10) Patent No.: US 7,019,233 B2
(45) Date of Patent: Mar. 28, 2006

(54) CLOSING DEVICE FOR DOORS, BONNETS, GATES OR THE LIKE, ESPECIALLY OF VEHICLES, SUCH AS MOTOR VEHICLES

(75) Inventor: Wolfgang Uwe Spies, Haan (DE)

(73) Assignee: Huf Hülsbeck & Fürst GmbH & Co. KG, Velbert (DE)

( * ) Notice: Subject to any disclaimer, the term of this patent is extended or adjusted under 35 U.S.C. 154(b) by 0 days.

(21) Appl. No.: 10/502,159

(22) PCT Filed: Nov. 30, 2002

(86) PCT No.: PCT/EP02/13543

§ 371 (c)(1),
(2), (4) Date: Jul. 21, 2004

(87) PCT Pub. No.: WO03/062569

PCT Pub. Date: Jul. 31, 2003

(65) Prior Publication Data

US 2005/0115810 A1 Jun. 2, 2005

(30) Foreign Application Priority Data

Jan. 23, 2002 (DE) ..... 102 02 371

(51) Int. Cl.
*H01H 9/00* (2006.01)
*H01H 27/06* (2006.01)

(52) U.S. Cl. ..... 200/61.62; 200/61.58 R; 200/332.2; 292/122; 362/488

(58) Field of Classification Search ..... 200/61.62, 200/61.7, 332.2, 333, 293, 329, 52 R; 292/121–122, 292/109; 362/488, 489, 154
See application file for complete search history.

(56) References Cited

U.S. PATENT DOCUMENTS 3,127,157 A 3/1964 Webb
4,776,620 A * 10/1988 Marks et al. ..... 292/228

(Continued)

FOREIGN PATENT DOCUMENTS

| | | |
|---|---|---|
| DE | 3413452 | 10/1985 |
| DE | 3447085 | 7/1986 |
| DE | 3627333 | 2/1988 |
| DE | 4421275 | 1/1995 |

(Continued)

*Primary Examiner*—Richard K. Lee
(74) *Attorney, Agent, or Firm*—Friedrich Kueffner

(57) ABSTRACT

The invention relates to a closing device consisting of a grip housing (10) containing a pivotably mounted grip flap (12). Said grip flap (12) is loaded by means of a restoring force (38) in the direction of its neutral position (12.1), against which force the manual actuation of the grip flap (12) must be carried out. Furthermore, an electrical switch (20) is associated with the grip housing (10), said switch comprising a spring-loaded (28) contact actuator (24). In order to provide a compact, cost-effective closing device, the restoring force (38) of the grip flap (12) can be directly generated by the spring-loading (28) of the contact actuator (24) of the electrical switch (20). In this way, separate springs are not required for the grip flap (12).

20 Claims, 5 Drawing Sheets

U.S. PATENT DOCUMENTS

| | | | | |
|---|---|---|---|---|
| 4,967,043 | A * | 10/1990 | Killarney | 200/1 B |
| 5,810,403 | A * | 9/1998 | Prada | 292/128 |
| 6,135,528 | A * | 10/2000 | Sobieski et al. | 296/37.7 |
| 6,140,713 | A | 10/2000 | Stringwell | |
| 6,315,436 | B1 * | 11/2001 | Schenk et al. | 362/488 |
| 6,761,381 | B1 * | 7/2004 | Prada et al. | 292/121 |
| 6,822,174 | B1 * | 11/2004 | Spies | 200/52 R |

FOREIGN PATENT DOCUMENTS

| | | | |
|---|---|---|---|
| DE | 19930861 | A1 * | 1/2001 |
| EP | 0411331 | | 2/1991 |
| FR | 2790780 | | 9/2000 |
| FR | 2802961 | | 6/2001 |
| GB | 1381729 | | 1/1975 |
| WO | 9801643 | | 1/1998 |

* cited by examiner

CLOSING DEVICE FOR DOORS, BONNETS, GATES OR THE LIKE, ESPECIALLY OF VEHICLES, SUCH AS MOTOR VEHICLES

The invention pertains to a closing device of the type indicated in the introductory clause of claim 1. A closing device of this type is used primarily on the rear hatches of vehicles. The grip housing is mounted in an opening made in the outer panel of the hatch. The grip flap and also the grip housing itself are advisably covered by a rubber skin, through which the grip flap can be actuated manually.

In the known closing device of this type (WO 98/01643, FIGS. 15–18), a projecting pin is provided a certain distance away from the pivot axis of the grip flap; this pin projects from an opening in the sidewall of the grip housing. On the outside surface of the sidewall of the housing, there is an electric switch with a contact actuator, upon which the projecting pin acts when the grip flap is actuated. Outside the grip housing, the cable leading to the electric switch is provided with clips, which serve to relieve the strain on the cable connected to the switch. To provide the restoring force for the grip flap, a ball is used, which is installed in a side opening in the grip flap and is spring-loaded by a compression spring. Inside the grip housing, the spring-loaded ball works together with a slanted surface, which slants toward the starting position of the grip flap. When the grip flap is manually actuated, the ball rolls down along the slanted surface and compresses the compression spring. One of the components of the force exerted by the compression spring provides a restoring force, which acts in the direction toward the starting position of the grip flap. When the grip flap was actuated, the ball rolled down the slanted surface. This known closing device is bulky and has many individual parts. These numerous parts complicate the assembly work and lead to relatively high production costs.

An electric snap switch is known (DE 44 21 275 A1), in which a contactor is spring-loaded by a spring in the outward-travel direction. An additional lever, which acts on the contacts by way of a plunger, is provided on the switch housing. Because of manufacturing tolerances, there are differences between the components, which cause different amounts of play between them. Therefore, the additional lever must be actuated with a sufficient amount of "overstroke". The contacts, however, are sensitive, for which reason excessive actuating forces can cause damage to the switch. This document does not propose any solution to this problem.

In a closing device for vehicles of a different type (FR 2 802 961 A1), a pivotably supported handle has two cams which act on two separately actuatable contacts of one complicated switch. The switch has angle-shaped plates, which are spring-loaded by springs and have curved surfaces which cooperate with the handle. One of the plates serves to unlock the closing device, the other to lock it. In front of the contacts there is an elastic shaft with an integrated diaphragm, which is moved by one of the angled arms of the associated plate. The handle itself, however, is not returned by the spring-loading of the plate; it has instead its own elastic restoring device, which tries to return it to its rest position. Whereas, in the rest position, the cams on the handle push the plates back against their springs, this is not the case when the handle is actuated; there is a certain gap between these surfaces and the arms of the handle. In this situation, no restoring force originating from the spring-loading of the contacts acts on the handle.

In the case of a rocker switch (EP 0 411 331 A2), it is known that a flexible contact tongue can be moved from a starting position to an actuating position by the actuation of a handle, which acts by way of a rigid plunger guided axially in the housing. The plunger may not undergo any radial deformation, because it would jam in its axial guide. The use of this switch for a grip flap in motor vehicles is neither intended nor feasible.

In the case of a door closing device for vehicles designed as a pull grip FR 2 790 780 A1), it is known that a switch with a spring-loaded actuator can be mounted on one end of a pull grip. When the supported end of the pull grip is pushed in, it actuates the switch. There is no deformable elastic element provided between the pull grip and the switch.

It is known (DE 100 20 172 A1) that a grip can be mounted in front of the contact actuator of an electric switch and can exert a restoring force on a membrane by means of disk springs or leaf springs. The membrane closes an opening in the grip housing and offers an actuating surface for the human hand.

In the case of an electronic key (DE 199 15 969 A1), finally, it is known that electric switches can be mounted in the key housing, and that the switches can be provided with plungers to serve as contact actuators. A housing wall consists of a plastic membrane, under which a plate-shaped support element is provided. This support element has drivers, which are aligned with the plungers of the electric switches and are seated in openings in the support element by way of torsion springs. These torsion springs exert a restoring force on the drivers to keep the plastic membrane pressed down into its starting position, in which the plungers of the switches are unactuated. When a human hand presses down on the membrane, the drivers of the support element actuate the plungers of the electric switches, for which purpose the restoring force acting on the drivers must be overcome.

In a known electric switch (U.S. Pat. No. 6,140,713), a pivotably supported grip is provided with a group of cams with various profiles, where a separate electric switch is assigned to each of these cams. Each of these switches consists of a pivotably supported contact actuation lever, which acts on a curved contact diaphragm by way of a flexible mat of rubber or silicone and a thickened area of mat located thereon. Although the elastic force of the contact diaphragm restores the associated contact actuation lever, it does not serve to restore the grip common to all the switches. In the rest position, a gap is present between the individual cams and the numerous associated contact actuation levers. If it is important for the grip to assume a defined rest position, it is necessary to provide a separate restoring spring. A stop for limiting the movement of the pivoting grip is neither present nor necessary; instead, as a result of the different heights of the cams, the individual electric switches are supposed to be actuated in a staggered manner as a function of the actuating angle of the pivoting grip.

In a key switch (DE 34 47 085 A1), it is known that a housing floor can be enclosed by the shell wall of a push button in the form of a half-shell, where an intermediate ring of plastic is installed between the push button and the housing floor. The intermediate ring is integrated into a ring-shaped head, seated on the inside surface of the push button; a ring-shaped base, which is supported on the inside surface of the housing floor; and a ring-shaped diaphragm between the head and the base, which exerts a restoring force on the push button when the button is actuated. The intermediate ring also has an actuating ring seated on the ring-shaped head, which, when the push button is actuated, bends an elastic contact bridge extending across the floor of the housing. During this action, the actuating ring can bulge laterally outward or slip sideways. The goal of this measure is to compensate for tolerances in the contact bridge. The contact bridge does not, however, serve to restore the push button; instead, as previously mentioned, the ring-shaped diaphragm, which is separate from the intermediate ring, is required for this purpose. It is impossible to see how a push button switch of this type could be of any use in a closing device with a grip flap according to the introductory clause of claim 1 of the invention.

The invention is based on the task of developing a low-cost closing device of the type indicated in the introductory clause of claim 1 which consists of only a few parts and which occupies a minimum of space, and where high actuating forces exerted by the grip flap will not damage the closing device. This is accomplished according to the invention by the measures cited in claim 1, to which the following special meaning attaches.

There is no need for a separate restoring spring to restore the grip flap, because this function is taken over by the switch spring of the electric switch, which is required in any case. In the invention, therefore, the number of components is reduced by one right from the start. Because an elastic element is provided between the contact actuator of the switch and the grip flap, this element is deformed when the grip flap arrives in its working position and presses against a stop on the housing, which stops the further actuation of the grip flap. The actuating force then acting on the grip flap is reduced to such an extent by the elastic deformation of the element that unallowably high forces cannot act on the switch. The elastic element acts as a "buffer" between the grip flap and the contact actuator of the electric switch. The elastic element is also useful in compensating for any tolerances which may lead to play between the various components. As a result of such tolerances, the grip flap can, when in its rest position, be various distances away from the stop of the grip housing. So that the position of the electric switch is reversed reliably when it is actuated, it is sufficient to provide an adequate amount of "overstroke" in the actuation path of the grip flap. This overstroke is compensated by the deformation of the elastic element.

It is recommended that the switch be installed under the grip flap. The switch itself is integrated into the grip housing, which is advisably designed as a shell. The shell shape is covered by the grip flap.

Additional embodiments of the invention can be derived from the subclaims. Several exemplary embodiments of the invention are illustrated in the drawings:

Figure 1:
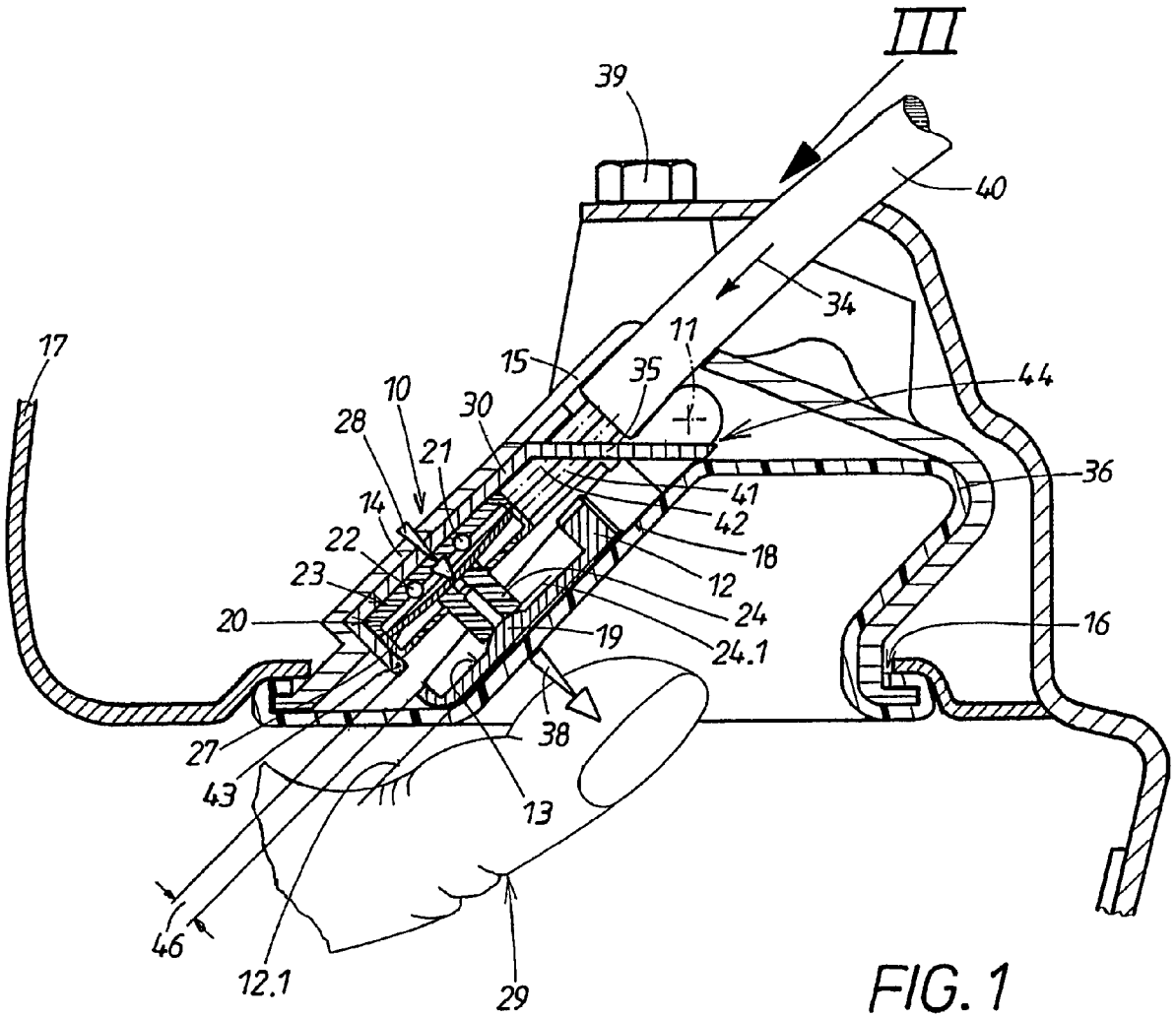
FIG. 1 shows a cross section through the inventive closing device before it is installed in the rear hatch of a vehicle, while the grip flap is in its rest position.
Figure 2:
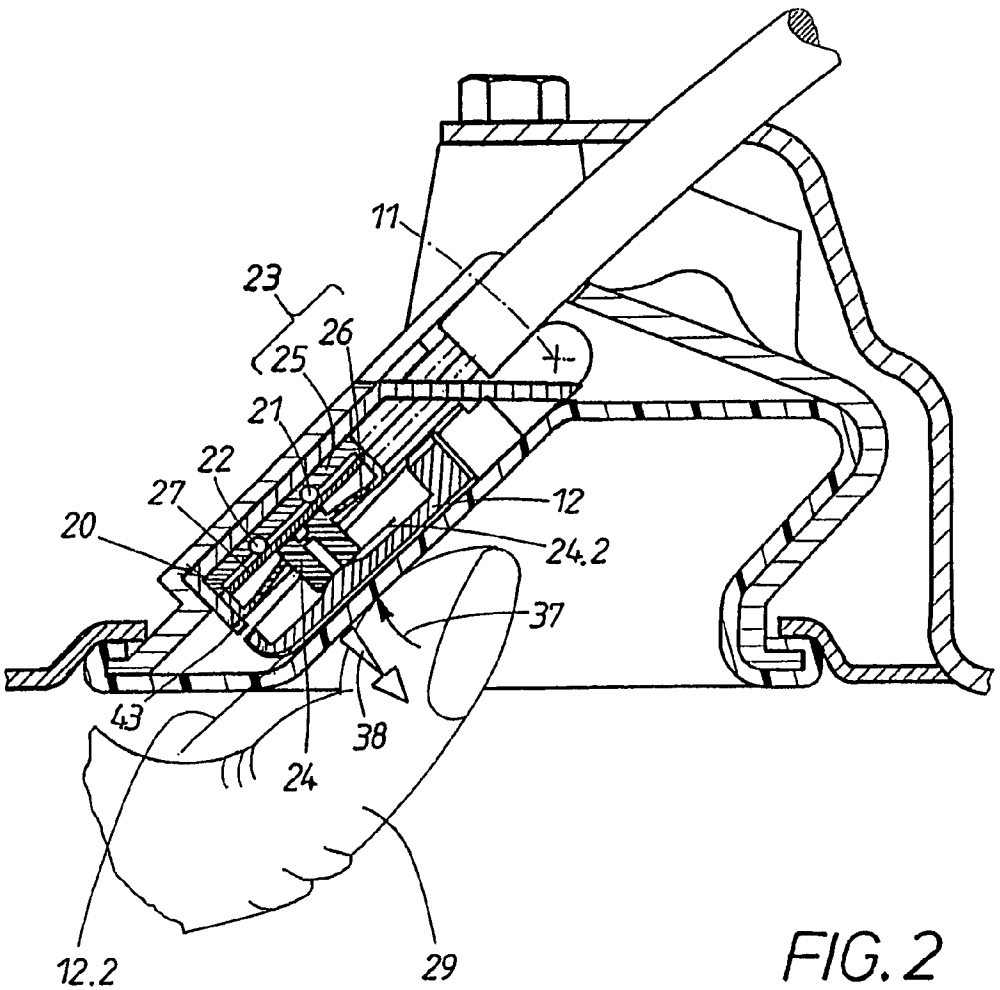
FIG. 2 shows the same closing device as that of FIG. 1, but with the grip flap in its working position.
Figure 4:
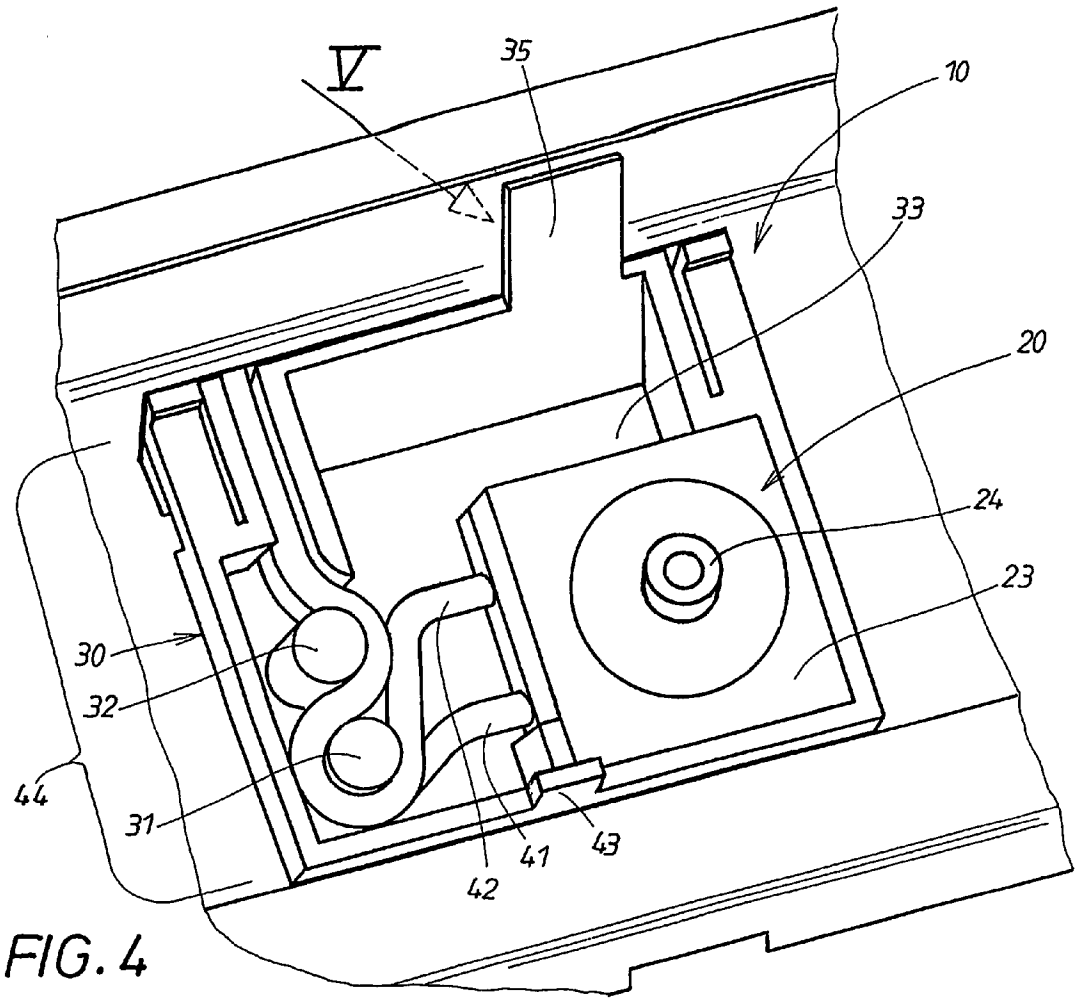
FIG. 4 shows a perspective view looking down onto the front side of the housing of the closing device shown in FIG. 3, after the electric switch in its mounting shell have been installed.
Figure 5:
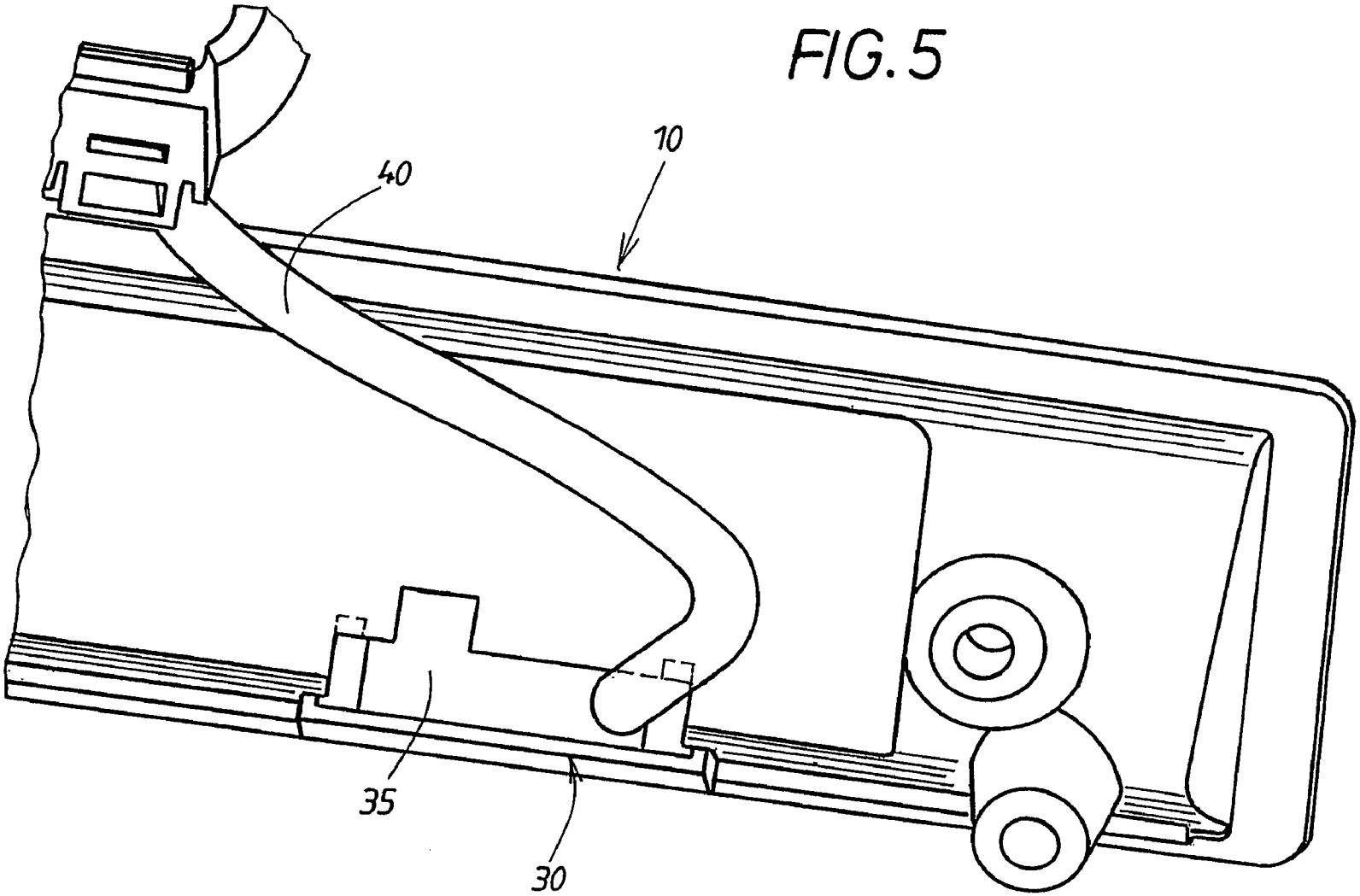
FIG. 5 is a view of the closing device similar to that of FIG. 3, showing the relationships which are present after the electric switch and the mounting shell have been installed in the grip housing.

The closing device shown in FIGS. 1 and 2 comprises a grip housing 10 with a grip flap 12, supported pivotably on the housing at 11. The grip housing 10 consists of a shell, which is open toward the bottom surface 13 of the grip flap 12. A mounting shell 30 is attached to the floor 14 of the housing shell to facilitate the installation of the switch 20; this mounting shell is also open toward the bottom surface 13 of the grip flap. These relationships are especially clear in FIGS. 3–5.

The grip housing 10 has an opening 15, through which an electric cable 40 can be passed, the two wires 41, 42 of which continue along the mounting shell 30 until they reach the electric switch, where they are connected to two stationary contacts 21, 22. Inside the mounting shell 30 there is also a strain-relief device 31, 32 for the electric cable 40. This device consists here of two pins 31, 32 seated in the interior 33 of the shell, around which the two cable wires 41, 42 are bent in labyrinthine fashion, namely, in the form of an "S". After the switch 20 and the cable have been installed, the interior 33 of the mounting shell 30 is filled with a casting compound (not shown). This compound at least partially covers the switch housing 23 and the two cable wires 41, 42 and ensures that the switch housing 23 remains permanently in place in the mounting shell 30. This group of parts forms a structural unit 44, which can be preassembled, consisting of the mounting shell 30, the switch 20 mounted in it, and the cable 40, seated in the strain-relief device 31, 32.

Figure 3:
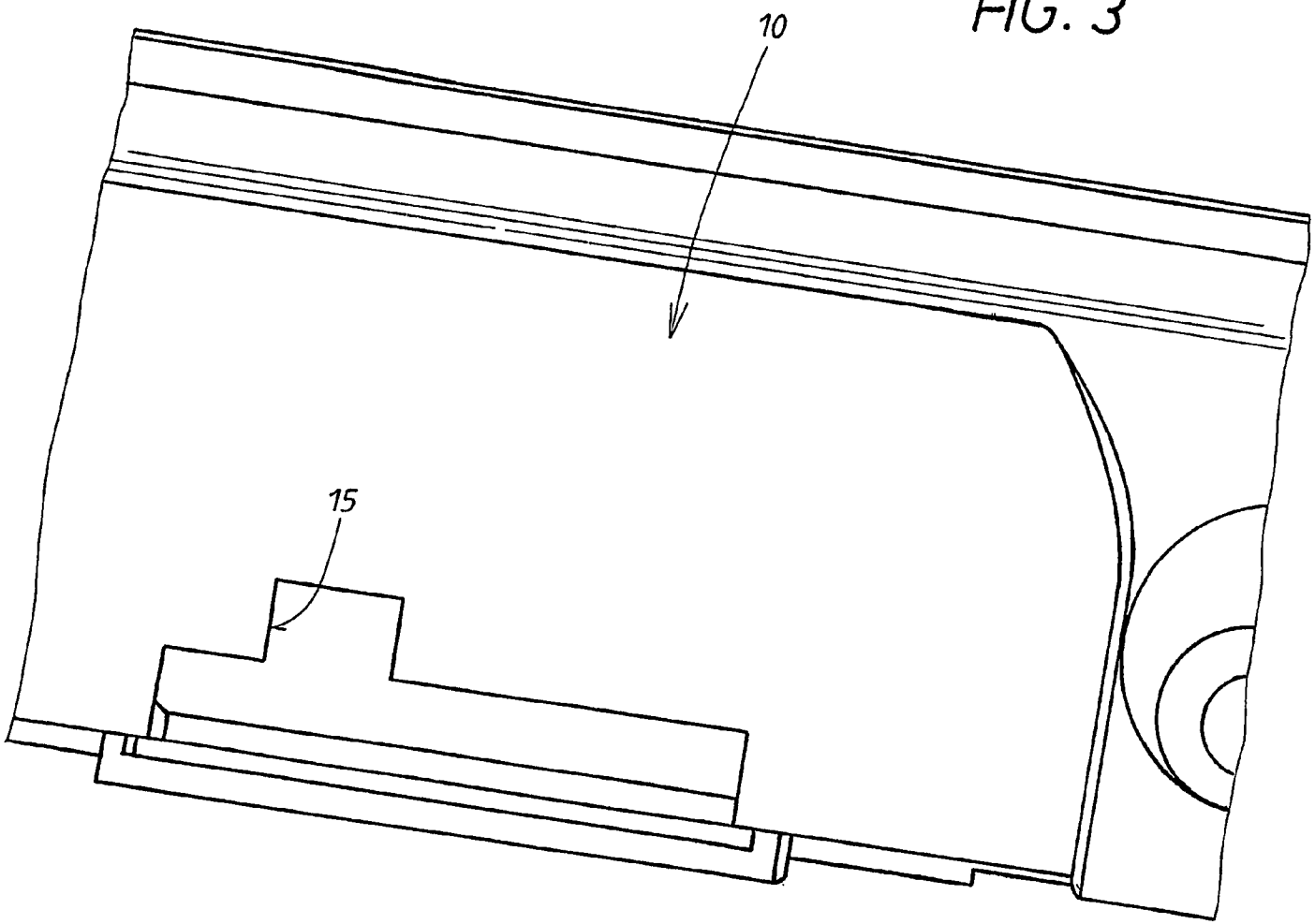
FIG. 3 shows a part of the grip housing of a closing device similar to that of FIGS. 1 and 2, namely, from the perspective of the rear of the housing, in the viewing direction of the arrow III in FIG. 1.

After it has been assembled, this structural unit 44 is introduced through the previously mentioned opening 15 in the grip housing 10. The opening, as FIG. 3 shows, is provided with a suitable profile. The profile of the opening has a step-like form so that, during the insertion motion illustrated by an installation arrow 34 in FIG. 1, the contact actuator 24 projecting from the unit can pass unhindered into the interior of the grip housing 10. Snap fasteners (not shown) ensure that the mounting shell 30 is held in a defined position in the grip housing 10. The mounting shell 30 has a tab 35 at one end with an outline which is complementary to the stepped shape of the opening 15; after installation, this tab essentially covers the opening 15. At first, only the grip flap 12, pivotably supported at 11, is seated in the grip housing 10.

FIG. 1 shows the installation position of the grip housing 10 in an opening 16 cut in the outside panel 17 of the rear hatch of a vehicle, the housing containing the previously mentioned structural unit 44. The opening of the shell-like grip housing 10 is covered by an elastomeric skin 36, which has a 3-dimensional profile; the central section of the skin rests against the outside surface 18 of the grip flap 12. The elastomeric skin and the grip housing 10 together form a capsule for the installed structural unit and for the grip flap 12. The edges of the skin 36 extend around the bent-over edges of the grip housing 10 and thus act as seals after the closing device has been attached to the outside panel 17 by screws 39.

FIG. 2 shows the details of the design of the electric switch 20 and illustrates its special function. The switch housing 24 comprises a relatively stiff bottom part 25 and an elastomeric upper part 26, on which the contact actuator 24 in the form of a plunger is formed. In the interior of the switch housing 23, between the two parts 25, 26, there is a curved diaphragm spring 27. When this spring is in the starting position, its curved part holds the contact actuator 24 in a defined starting position, which is illustrated in FIG. 1 by an auxiliary line labeled 24.1. The diaphragm spring 27 exerts an elastic load on the contact actuator 24 as illustrated by the force arrow 28 in FIG. 1. The front end of the plunger-like contact actuator 24 touches a projection 19 provided on the bottom surface 13 of the grip flap 12; it is possible for a positive engagement to be produced here.

The diaphragm spring 27 consists of electrically conductive material. In the starting position 24.1 of FIG. 1, the diaphragm spring 27 is a certain distance away from the two stationary contacts 21, 22. In this first contact position, which is the position normally present, the two electrical contacts 21, 22 are not connected to each other; the switch 20 is in its "off" position. The spring-loading 28 of the contact actuator 24 serves in the present case to hold the grip flap in the rest position in the grip housing 10 shown in FIG. 1, as illustrated in FIG. 1 by the auxiliary line 12.1. The spring-loading 28 of the diaphragm spring 27 provides a restoring action on the grip flap 12 in the direction toward this rest position 12.1. This restoring force is illustrated by a force arrow 38 in FIG. 1.

In the original state, the grip housing 10 is provided only with the grip flap 12 mounted inside; if desired, the elastomeric skin 36 can also be inserted at this point. In this partially assembled state, the grip flap 12 is not yet spring-loaded by a restoring force. This restoring force is not produced until the structural unit 44 is installed. This is inserted into the previously mentioned assembly in the direction of the previously mentioned installation arrow 34 and then fixed in place there by means of latching devices (not shown). Then the contact actuator 24 comes to rest against the projection 19 on the grip flap 12 and provides the previously mentioned restoring force 38.

As previously mentioned, the grip flap 12 is normally in its rest position 12.1 shown in FIG. 1. The flap remains in this position until a human hand 29 actuates the elastomeric skin 36.

This situation changes when a hand 29, as FIG. 2 shows, exerts pressure on the grip flap 12 and therefore pivots it in the direction of the pivot arrow 37 around the pivot axis 11. Then the plunger-like contact actuator 24 is pressed inward and arrives in its actuating position, indicated by the auxiliary line 24.2 in FIG. 2. In this actuating position 24.2, the diaphragm spring 27, which rests against the inside end of the contact actuator 24, flattens out until electrical contact is established between the two stationary contact parts 21, 22. The switch 20 is thus now in its "on" state, as a result of which the desired functions in the associated closing device can proceed. The position of the grip flap illustrated by the auxiliary line 12.2 in FIG. 2 proves to be the effective working position of the grip flap 12. The previously mentioned actuation 37 in the direction toward the working position 12.2 must proceed in opposition to the restoring force 38. When the human hand 29 releases the grip flap 12, the flap will move back into its rest position 12.1 of FIG. 1 as a result of the spring-loading 28 acting on it from the side where the spring is located. During the previously mentioned actuation 37 of the grip flap, the diaphragm spring 27 is put under even greater tension and thus produces an even greater elastic force 28 than that present in FIG. 1.

In some cases it would also be possible to install the switch on the outside surface of the grip housing 10 and to introduce the plunger-like contact actuator 24 into the interior of the housing through an appropriate opening. The grip flap 12 would be supported in the same way as that shown in FIG. 1.

In the present exemplary embodiment, the mounting shell 30 is provided with an elevation 43, which serves as a stop for the grip flap 12 during the actuation process. The design of the elevation 43 can be seen very clearly in FIG. 4. As a result of the stop action of the elevation 43, an overstroke is prevented, and damage to the components which could be caused by excessive actuating force is avoided. The elevation 43 could also be component of the housing 10 in certain cases.

If it is desired to increase the restoring force 38 acting on the grip flap 12, this can be easily realized by stacking several diaphragm springs 27 on top of each other in the interior of the switch 20. As a result, the restoring force 38 can be easily doubled or tripled. In place of a diaphragm spring 27, it would also be possible for the spring-loading 28 of the contact actuator 24 to be provided by other types of springs known in and of themselves, such as compression springs.

Figure 6:
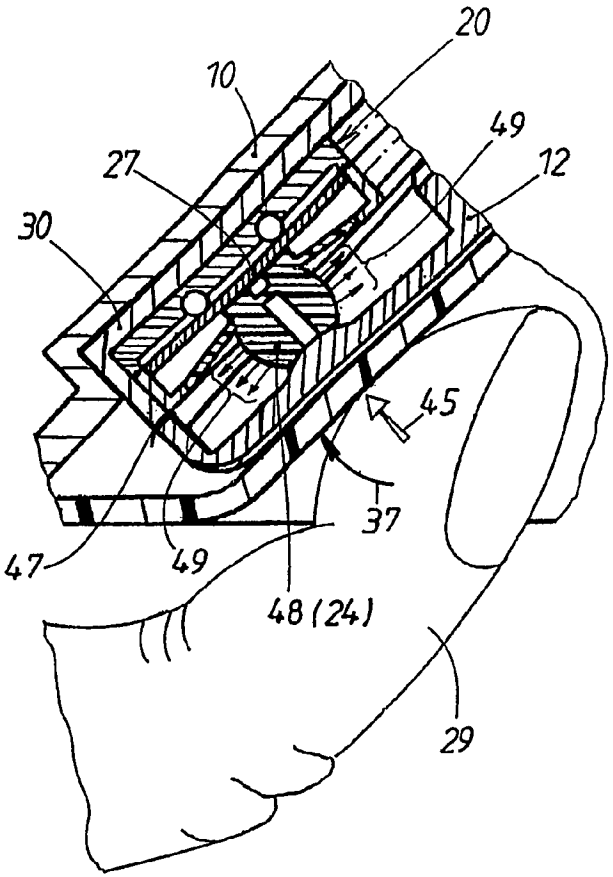
FIG. 6 shows an alternative design of the closing device similar to FIG. 2 on an enlarged scale.

When the electric switch 20 is actuated, it may be subjected only to a certain maximum actuating force, which is designated by the number 45 in FIG. 6. In the rest position of the grip flap, shown in FIG. 1, there is a gap 46 between the grip flap 12 and the grip housing 10; this gap is larger than the distance which the diaphragm spring 27 travels between the two contact positions 24.1 and 24.2 in FIGS. 1 and 2. For design reasons, however, there is a certain amount of play between the components, and in certain cases this play can have the effect of changing the size of the previously mentioned gap 46. Thus the system must be capable of tolerating a certain amount of overstroke.

In order to protect the electric switch 20 from excessive actuating force 45 in the latter case as well, it is proposed that an elastic element 48 be installed between the contact actuator 24 and the grip flap 12. This elastic element 48 is intended to transmit the actuating force 45 illustrated in FIG. 6 to the electrical switch 20. The elastic element 48 can be deformed when the actuating force 45 it is transmitting exceeds a certain value. This deformation continues until, during the movement 37 also indicated in FIG. 6, the grip flap 12 comes to rest against the grip housing 10 or against the mounting shell 30 seated therein, as shown at 47 in FIG. 6. In the present case, the elastic element 48 is formed by the contact actuator 24 of the electric switch 20 itself.

This contact actuator 24 is designed here as a plunger and consists of elastomeric material. It has been assumed in FIG. 6 that the actuating force 45 is strong enough to have deformed the plunger material to the extent illustrated by the deformation arrows 49. The cylindrical plunger thus assumes a convex shape. This has the effect of protecting the switch 20.

FIG. 6 shows the simplest way in which an elastic element can be provided in this area. Another possibility consists in installing, for example, a separate spring element between the bottom 13 of the grip flap 12 shown in FIG. 1 and the contact actuator 24 of the switch 20.

LIST OF REFERENCE NUMERALS

10 grip housing
11 pivot axis
12 grip flap
12.1 rest position of 12
12.2 working position of 12
13 bottom of 12
14 shell bottom of 10
15 opening in 10
16 cutout in 17
17 outer panel
18 outside surface of 12
19 projection on 13 for 24
20 electric switch
21 first contact of 20

22 second contact of 20
23 switch housing of 20
24 contact actuator of 20
24.1 starting position of 24
24.2 actuating position of 24
25 bottom part of 23
26 elastomeric upper part of 23
27 diaphragm spring of 20
28 force arrow of the spring-loading of 24
29 human hand
30 mounting aid, mounting shell
31 strain-relief device of 40, first pin
32 strain-relief device of 40, second pin
33 shell interior of 30
34 mounting arrow of 44 in 10
35 terminal tab of 30
36 elastomeric skin on 10
37 pivot-motion arrow of 12
38 arrow of the restoring force of 12
39 screw for 10 (FIG. 1)
40 electric cable
41 conductor of 40, first wire of 40
42 conductor of 40, second wire of 40
43 elevation, stop on 30
44 structural unit
45 actuating force for 12 or 20 (FIG. 6)
46 gap between 12 and 10 (FIG. 1)
47 contact between 13 and 30 (FIG. 6)
48 elastic element, elastomeric plunger (FIG. 6)
49 deformation arrows of 48 or 24 under 45 (FIG. 6)

The invention claimed is:

1. Closing device for doors, hoods, or hatches, especially of motor vehicles, with a grip flap (12), pivotably supported (11) in a grip housing (10), which flap is held by a restoring force (38) in a rest position (12.1) in the housing (10) and is manually actuated (37) to move it into its working position (12.2), and with an electric switch (20), which has a contact actuator and a switch spring (27), the contact actuator (24) is held by the spring-loading (28) of the switch spring in a starting position (24.1), in which the switch (20) is in a first contact position; and upon actuation (37) of the flap (12), the contact actuator (24) is moved against the spring-loading (28) of its switch spring (27) into an actuating position (24.2), in which the switch (20) is in its second contact position, wherein the restoring force (38) for the grip flap (12) is produced by the switch spring (27) of the electric switch; in that a stop (43), which limits the actuating travel (37) of the grip flap (12) in the direction toward its working position (12.2), is provided on the grip housing (10); in that an elastic element (48) is provided between the contact actuator (24) and the grip flap (12); and in that when the actuated grip flap (12) is in contact with the stop (30), the elastic element (48) is elastically deformed to such an extent, and thus the actuating force (45) of the grip flap (12) arriving at the electric switch (20) is reduced to such an extent, that the maximum force allowed for actuating the switch (12) is not exceeded.

2. Closing device according to claim 1, wherein the elastic element (48) consists of a spring element.

3. Closing device according to claim 1, wherein the elastic element (48) is formed by the contact actuator (24) of the electric switch (12) itself.

4. Closing device according to claim 1, wherein the contact actuator (24) consists of a plunger, which is spring-loaded (28) by the switch spring (27) in the longitudinal direction.

5. Closing device according to claim 4, wherein the plunger points toward the bottom surface (13) of the grip flap (12).

6. Closing device according to claim 4, wherein the plunger consists of elastomeric material and also takes over the function of the elastic element (48) during the transmission of the actuating force (45), and in that the plunger assumes a convex shape (49) when the elastic element is deformed.

7. Closing device according to claim 1, wherein the electric switch (20) is located on the outside of the grip housing (10), and in that the contact actuator (24) acts directly on the grip flap (12).

8. Closing device according to claim 1, wherein the electric switch (20) is located in the interior of the grip housing (10), and in that the contact actuator (24) acts (19) directly on the grip flap (12).

9. Closing device according to claim 1, wherein the switch spring (27) of the plunger (24) consists of a curved diaphragm spring, which is attached around its periphery to the switch housing (23); in that, in the starting position (24.1), the curvature of the diaphragm (27) is directed away from the stationary contacts (21, 22); and in that, in the actuating position (24.2), the curvature of the diaphragm (27) is directed toward the contacts (21, 22).

10. Device according to claim 9, wherein, to increase the restoring force (38) acting on the grip flap (12), the diaphragm spring (27) can be designed to consist of several layers.

11. Closing device according to claim 1, wherein the grip housing (10) has an opening (15), through which an electric cable (40) can pass, the conductors (41, 42) of which proceed into the switch housing (23), where they are connected to the electric contacts (21, 22).

12. Closing device according to claim 1, wherein the grip housing (10) consists of a shell, which is open toward the bottom surface (13) of the grip flap (12), in which shell the switch housing (23) and possibly a mounting aid (30) are provided.

13. Closing device according to one of claim 1, wherein the electric switch (20) is held in place in a mounting shell (30), and in that, when the mounting shell (30) is installed, it latches into position in the grip housing (10).

14. Closing device according to claim 13 with a strain-relief device for the electric cable (40) assigned to the electric switch (20), wherein the strain-relief device (31, 32) is integrated into the mounting shell (30).

15. Closing device according to claim 14, wherein the strain-relief device (31, 32) consists of a labyrinthine guide for the electrical conductors (41, 42), which guide is an integral part of the mounting shell (30).

16. Closing device according to claim 15, wherein the strain-relief device consists of two pins (31, 32) seated in the interior (33) of the shell, around which the electrical conductors (41, 42) of the cable (40) pass in the form of an "S".

17. Closing device according to claim 13, wherein the mounting shell (30) is filled with a casting compound, which at least partially covers the electric switch (20) and/or the electrical conductors (21, 22).

18. Closing device according to claim 17, wherein the casting compound serves to hold the switch housing (23) permanently in position in the mounting shell (30).

19. Closing device according to claim 1, wherein an elevation, which serves as a stop (43) for the grip flap (12), is provided on the mounting shell (30) or on the housing (10).

20. Closing device according to claim 1, wherein the mounting shell (30), the switch (20) mounted in it together with the restoring force (38) acting on the grip flap (12), and the cable (40) seated in the strain-relief device (31, 32) form a structural unit (44) which can be preassembled, and in that the structural unit (44) can first be assembled, then inserted (34) into the housing (10), and finally fixed in place therein (10).

* * * * *